US007208887B2

(12) United States Patent
Mosebrook et al.

(10) Patent No.: US 7,208,887 B2
(45) Date of Patent: Apr. 24, 2007

(54) BALLAST HAVING MULTIPLE CIRCUIT FAILURE PROTECTION AND METHOD FOR BALLAST CIRCUIT PROTECTION

(75) Inventors: Donald R. Mosebrook, Bethlehem, PA (US); Dragan Veskovic, Allentown, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 141 days.

(21) Appl. No.: 11/011,253

(22) Filed: Dec. 14, 2004

(65) Prior Publication Data

US 2006/0125417 A1 Jun. 15, 2006

(51) Int. Cl.
*G05F 1/00* (2006.01)

(52) U.S. Cl. ..... 315/307; 315/209 R; 315/291; 315/247; 315/224; 315/DIG. 7

(58) Field of Classification Search ..... 315/209 R, 315/200 R, 127, 119, 291, 307, 362, 224, 315/219, 225, 247, 244, 292, DIG. 4, DIG. 7
See application file for complete search history.

(56) References Cited

U.S. PATENT DOCUMENTS

| | | | | |
|---|---|---|---|---|
| 6,534,930 | B2 * | 3/2003 | Ito et al. | 315/291 |
| 2002/0047634 | A1 | 4/2002 | Ito et al. | |
| 2002/0158591 | A1 | 10/2002 | Ribarich et al. | |
| 2005/0128666 | A1 * | 6/2005 | Pogodayev et al. | 361/58 |
| 2006/0125426 | A1 * | 6/2006 | Veskovic et al. | 315/312 |

FOREIGN PATENT DOCUMENTS

DE 44 01 630 A1 7/1995

OTHER PUBLICATIONS

International Search Report dated Mar. 20, 2006.

* cited by examiner

*Primary Examiner*—Haissa Philogene
(74) *Attorney, Agent, or Firm*—Ostrolenk, Faber, Gerb & Soffen, LLP

(57) ABSTRACT

A ballast for a gas discharge lamp comprising a first circuit portion for providing power to a lighting load and a second circuit portion for processing data exchanged with a communication link, the first circuit portion receiving power from an AC main supply for conversion to a form suitable to supply power to the lamp, and the second circuit portion having a power supply supplied from the AC main supply, the power supply being coupled at the input of the AC main supply to the first circuit portion, further comprising a first protection circuit coupled in series with the AC main supply for protecting the first and second circuit portions in the event of an electrical circuit failure leading to an overcurrent condition, the power supply for the second circuit portion being coupled such that it is protected by the first protection circuit; further comprising a second protection circuit disposed in series with the first circuit portion and providing protection only in the event of electrical failure leading to an overcurrent condition in the first circuit portion; the second protection circuit adapted so that in the event of electrical failure in the first circuit portion, the second protection circuit will discontinue the supply of current to the first circuit portion, thereby preventing an overcurrent in the first protection circuit that would cause the first protection to interrupt current, and thereby allowing the first protection circuit to continue to supply electrical current to the second circuit portion.

21 Claims, 4 Drawing Sheets

BALLAST HAVING MULTIPLE CIRCUIT FAILURE PROTECTION AND METHOD FOR BALLAST CIRCUIT PROTECTION

BACKGROUND OF THE INVENTION

The present invention relates to power supplies, an in particular, to an intelligent ballast for powering a lighting load, for example a gas discharge lamp such as a fluorescent lamp. The present invention relates to ballasts of the type disclosed in the Assignee's U.S. patent application Ser. No. 10/824,248 filed Apr. 14, 2004 and entitled Multiple-Input Electronic Ballast With Processor, the entire disclosure of which is incorporated herein by reference.

In the ballast disclosed in the above-identified pending patent application, the ballast includes an input or front end power circuit section that includes an RF filter and rectifier and a valley fill circuit including an energy storage capacitor, for providing a DC bus voltage. The DC bus voltage is provided to a back end or output stage including an inverter and an output filter. In the back end, an inverter is driven to provide a high frequency AC output voltage that is filtered by an output filter and provided as the voltage supply to the lighting load.

The ballast includes a processing section including a microprocessor which receives inputs, from both internal sources within the ballast itself and from external sources. For example, the internal sources of inputs may include an input voltage from the AC main supply, an input voltage from the DC bus concerning the DC bus voltage, an input concerning the output lamp current, and an input from the output voltage to the lamp. In addition, external sources of inputs to the ballast may include an external photosensor, an infrared receiver, a phase-control dimmer, and an analog voltage source. Furthermore, the processor has a communication port that receives information via the DALI or other communications protocol. DALI stands for Digital Addressable Lighting Interface and is described in an International Electrotechnical Commission document IEC 60929. The DALI communication port, microprocessor, and sensor input circuitry are powered by a power supply which receives rectified AC voltage from the output of the rectifying circuit.

In the above-described ballast, a fuse is placed to protect the ballast in the event of ballast failure, for example a power circuit short. However, if the ballast fails, and the fuse blows, the entire ballast fails including the processing section. This presents a problem because in the processing section handles incoming information from attached sensors and communicates this information to the communication link via the communication port for use by other system components. If the ballast fails and the fuse blows as a result of a fault in the power circuit section, it is undesirable to have the processing circuit portion also be without power. If the processing section is without power, then the information from any connected sensors is no longer available to the rest of the system. Thus, a single ballast failure in the power circuit portion can have far reaching consequences to the system if the ballast that fails is one that has a sensor connected to it.

It is therefore desirable to provide a ballast circuit such that, if a failure occurs in the portion of the ballast that supplies lamp power, only the power circuit section will be without power when circuit power is interrupted and the remaining processing portion that processes inputs from the sensors connected to the ballast, continues to operate.

SUMMARY OF THE INVENTION

According to the invention, a ballast is provided comprising a first circuit portion for providing power to a lighting load, and a second circuit portion for processing data exchanged with a communication link, the first circuit portion receiving power from an AC main supply for conversion to a form suitable to supply power to the lighting load, and the second circuit portion having a power supply supplied from the AC main supply, the power supply being coupled at the input of the AC main supply to the first circuit portion, further comprising a first protection circuit coupled in series with the AC main supply for protecting the first and second circuit portions in the event of an electrical circuit failure leading to an overcurrent condition, the power supply for the second circuit portion being coupled such that it is protected by the first protection circuit; further comprising a second protection circuit disposed in series with the first circuit portion and providing circuit protection only in the event of electrical failure leading to an overcurrent condition in the first circuit portion; the second protection circuit being rated such that in the event of electrical failure in the first circuit portion, the second protection circuit will discontinue the supply of current to the first circuit portion thereby preventing an overcurrent in the first protection circuit that would cause the first protection circuit to interrupt current, and thereby allowing the first protection circuit to continue to supply electrical current to the second circuit portion.

Other features, objects and advantages of the present invention will become apparent from the detailed description that follows:

BRIEF DESCRIPTION OF THE DRAWING(S)

The invention will now be described in the following detailed description with reference to the drawings in which.

DETAILED DESCRIPTION OF THE INVENTION

Figure 1:
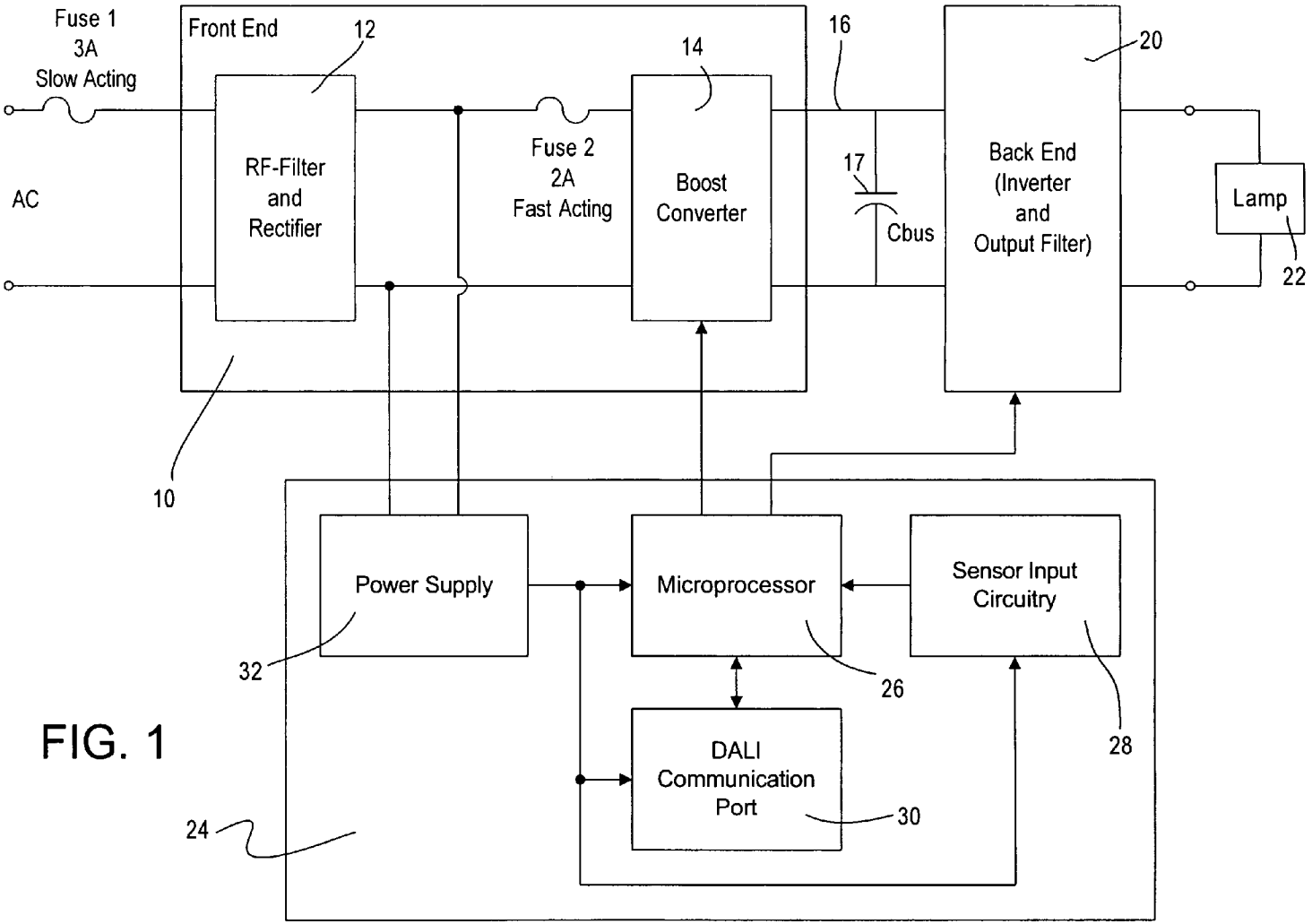
FIG. 1 is a block diagram of a first embodiment of the protected ballast according to the present invention.

With reference now to the drawings, FIG. 1 is a block diagram of a first embodiment of a ballast according to the present invention. As described above, the ballast includes a power circuit section 8 having a front end or input section 10, a DC bus 16 having a bus capacitor 17 coupled thereacross, and a back end or output section 20 that supplies a lamp load 22 with power. The front end 10 includes an RF filter and rectifier 12 and a boost converter 14 and the back end includes an inverter and an output filter. Note that the boost converter can be any type of active or passive power factor correcting circuit. The ballast also includes a processing section 24 including a microprocessor 26, sensor input circuitry 28 that receives inputs from external sensors such as occupancy sensors, photosensors, and infrared sensors, as well as other inputs from the power circuit section 8 of the ballast itself to monitor and control the operation of the ballast. The microprocessor 26 is also connected to a communication port 30 for exchanging data with a communication link (not shown). The microprocessor 26 receives information via a communication port 30 from other ballasts or other devices, such as a central controller (not shown). The microprocessor 26 also transmits information, such as the sensor input information from the sensor input circuitry, over the link to other ballasts and the central controller. The communication port 30 may operate according to the DALI standard or any other suitable communications protocol.

The processing section 24 is powered by a power supply 32 that draws current from the AC main supply through the RF filter and rectifier 12. Because the power supply 32 takes advantage of the rectifier in the front end 10, the power supply does not need an internal rectifier.

A first protection circuit comprising a main fuse 1 is provided at the AC input of the ballast and all current supplied to the ballast flows through this fuse.

According to the invention, a second protection circuit is provided. In particular, a second fuse 2 is provided in addition to the main fuse 1 provided on the AC line. Second fuse 2 is disposed in series with the power circuit section 8 and, in particular, is located between the RF filter and rectifier 12 and the boost converter 14.

In the illustrated embodiment, the main fuse 1 on the AC line is preferably a slow acting fuse and is preferably rated such that it is of a larger current rating than the second fuse 2. The second fuse 2 is preferably a fast acting fuse and rated at a smaller current rating than the main fuse 1. In the illustrated embodiment, the main fuse is a three amp, slow acting fuse and the second fuse is a two amp, fast acting fuse. Although fuses are shown, other circuit protection elements can be used such as circuit breakers.

This arrangement has the following desirable effects. Should a failure occur in the boost converter 14 or the back end 20 of the powertrain section 8 of the ballast, the fast acting second fuse 2 will blow rapidly, without blowing the first main fuse 1. Once the second fuse 2 blows, the second fuse 2 will discontinue the supply of current to the boost converter 14 and the back end 20, so as to prevent an overcurrent in the first fuse 1 that would cause the first fuse 1 to interrupt current. Thus, the first fuse 1 will remain conducting and power will be provided to the processing portion of the ballast, enabling the sensor inputs to be provided over the communication link by the microprocessor communications port 30. The components used in the RF filter and rectifier 12 are generally more robust than the components of the boost converter 14 and back end 20, which comprise semiconductor switches that tend to fail due to shorts and electrolytic capacitors that tend to dry up as they age. Thus, the power supply 32 can use the rectified voltage at the output of the RF filter and rectifier 12 and does not need an internal rectifier.

Figure 2:
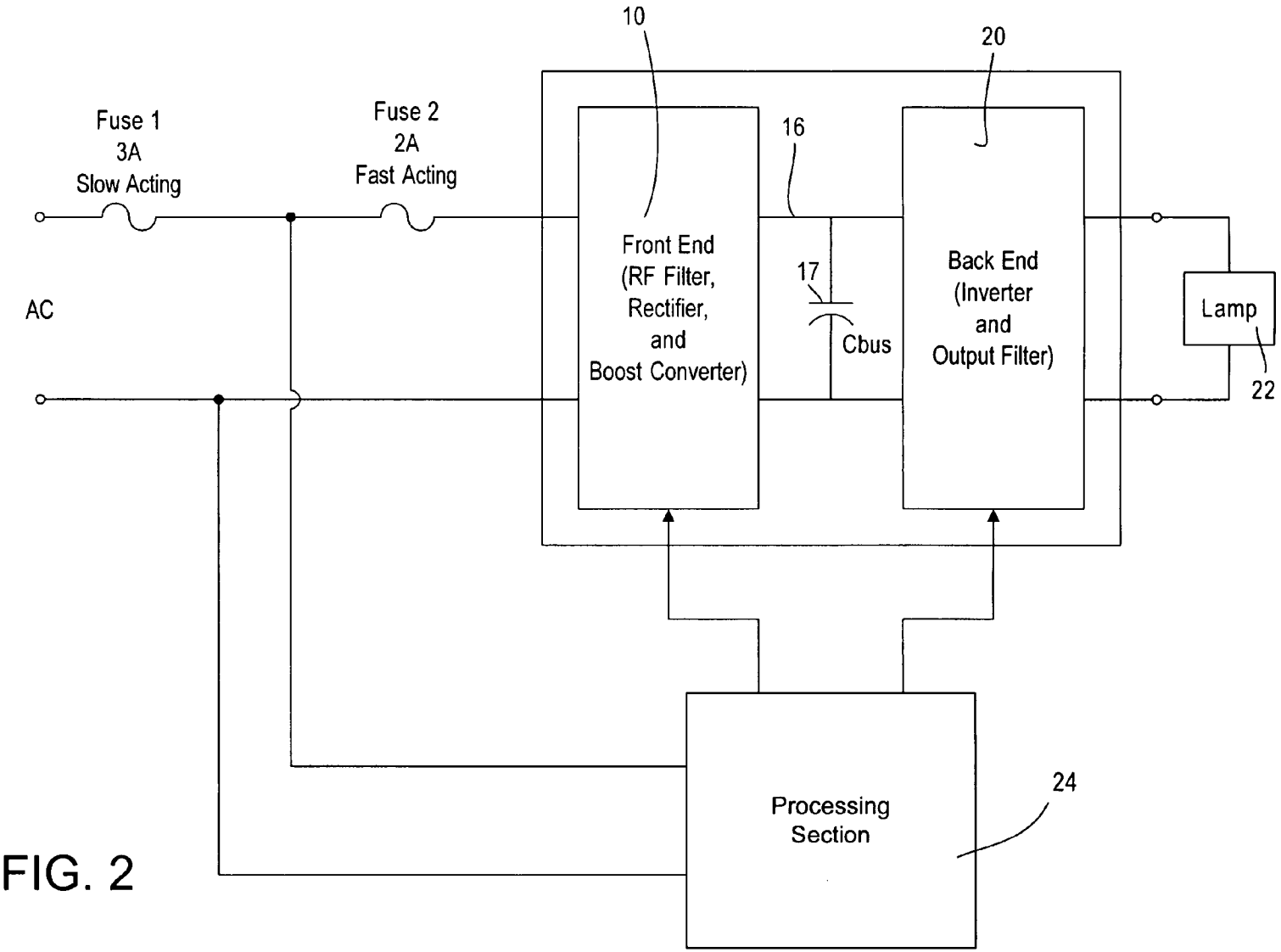
FIG. 2 is a block diagram of a second embodiment of the protected ballast.

As shown, the second fuse 2 may be provided between the RF filter and rectifier 12 and boost converter 14. However, the second fuse 2 can also be provided before the RF filter and rectifier 12 but after the junction of the AC main supply with the power supply 32 as shown in FIG. 2. By placing the fuse 2 ahead of the front end 10, should the RF filter and rectifier 12 fail, or should there be a fault anywhere else in the powertrain section 8 of the ballast, the fuse 2 will blow prior to the first fuse 1 blowing, thereby continuing to provide power to the processing section 24.

Although the invention shows the main fuse 1 having a larger current rating than the second fuse 2, that is, in the illustrated embodiments, 3 amp for the main fuse 1 and 2 amp for the second fuse 2, it is also possible that the main fuse 1 can have the same rating as the second fuse 2 but simply be a slow acting fuse whereas the second fuse 2 is a fast acting fuse. Thus, the second fuse 2 will still blow more quickly than the main fuse 1 in the event of a power circuit portion failure in the ballast. Once the second fuse 2 blows, the overcurrent condition will be discontinued and thus the main fuse 1 will continue to provide power to the processing section 24 of the ballast and thereby operation of the sensors, microprocessor, and communication port will continue, thus allowing sensor data from sensors attached to the failing ballast to continue to be exchanged with the network.

Should a failure occur in the processing section 24 leading to an overcurrent condition, the first fuse 1 is designed to blow to discontinue power to the entire ballast.

Figure 3:
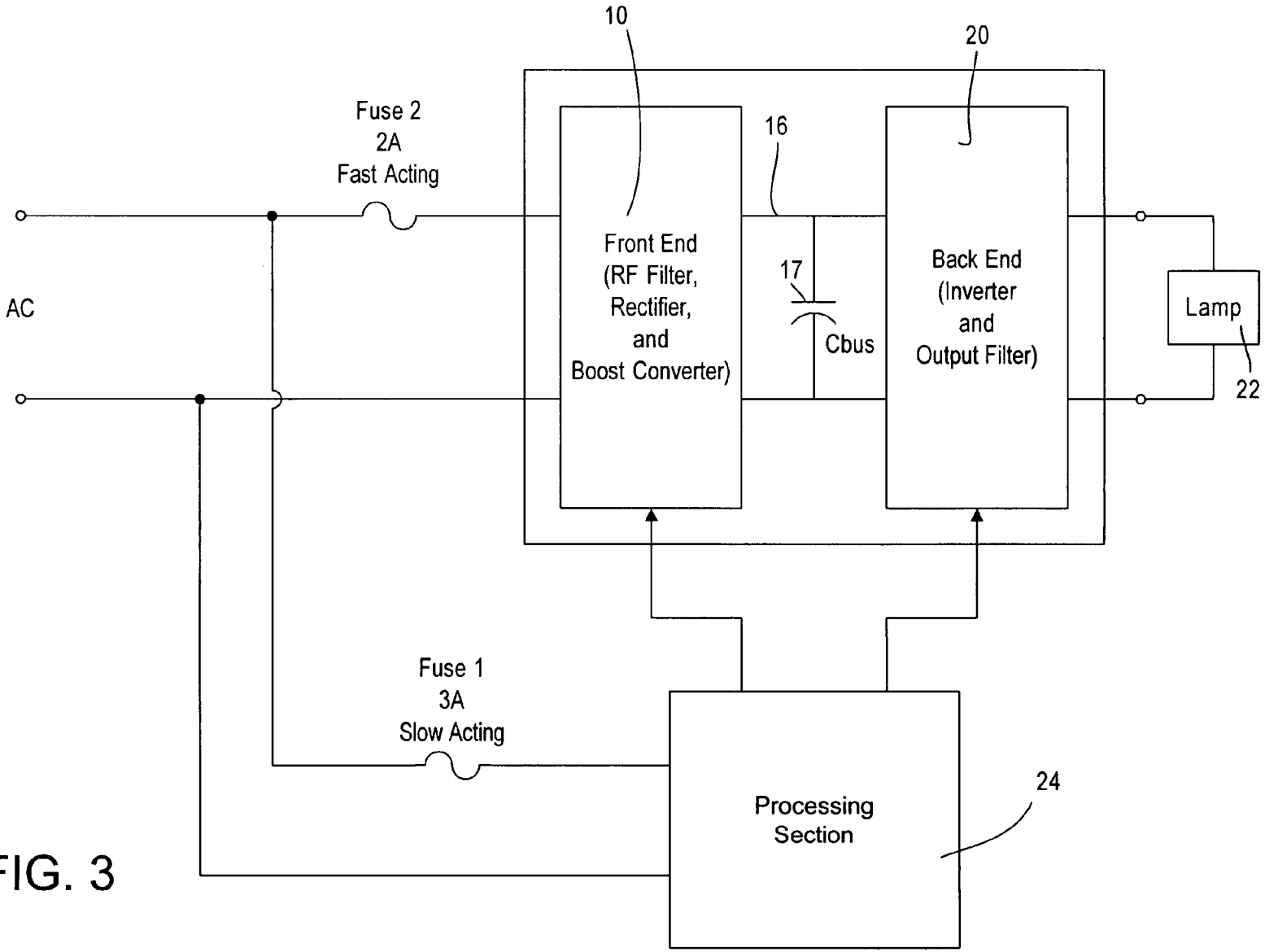
FIG. 3 is a block diagram of a third embodiment of the protected ballast.
Figure 4:
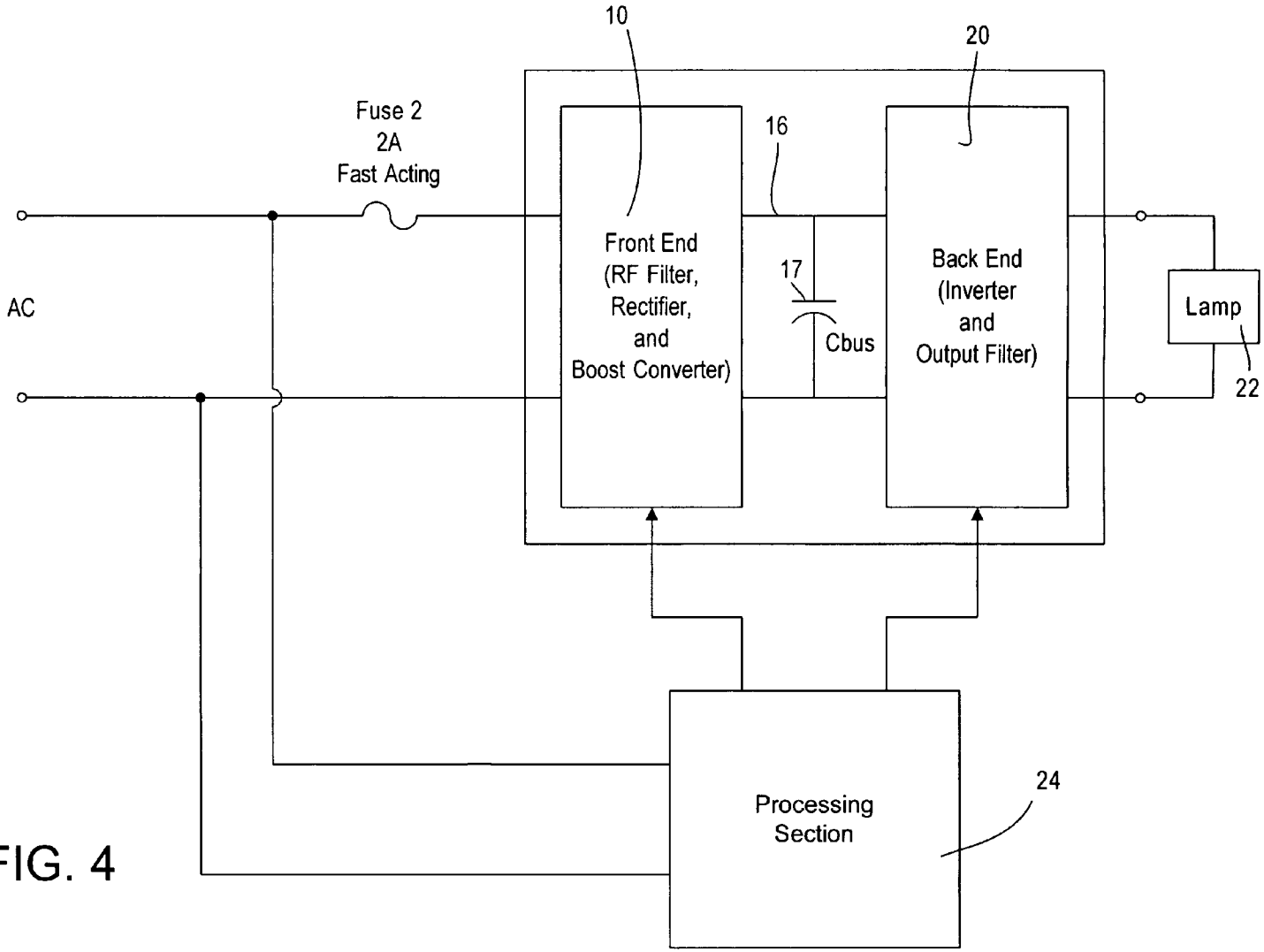
FIG. 4 is a block diagram of a fourth embodiment of the protected ballast.

FIG. 3 and FIG. 4 show block diagrams of a third and a fourth embodiment of the protected ballast, respectively.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A ballast for a gas discharge lamp comprising:

a first circuit portion for providing power to the lamp, the first circuit portion adapted to receive power from an AC main supply for conversion to a form suitable to supply power to the lamp;

a second circuit portion for processing data exchanged with a communication link, the second circuit portion having a power supply supplied from the AC main supply, the power supply coupled at the input of the AC main supply to the first circuit portion;

a first protection circuit coupled in series with the AC main supply for protecting the first and second circuit portions in the event of an electrical circuit failure leading to an overcurrent condition, the power supply for the second circuit portion being coupled such that it is protected by the first protection circuit; and a second protection circuit disposed in series with the first circuit portion and providing protection only in the event of an electrical failure leading to an overcurrent condition in the first circuit portion, the second protection circuit being adapted such that in the event of an electrical failure in the first circuit portion, the second protection circuit will discontinue the supply of current to the first circuit portion so as to prevent an overcurrent in the first protection circuit that would cause the first protection circuit to interrupt current;

thereby allowing the first protection circuit to continue to supply current to the second circuit portion;

wherein the second circuit portion further comprises a sensor input portion adapted to receive a sensor input provided from an external sensor, and wherein the second circuit portion includes a communication port for exchanging data with a communications link, and wherein, in the event of an electrical failure in the first circuit portion leading to operation of the second protection circuit, the second circuit portion is adapted to continue receiving power from the power supply, thereby allowing the sensor input to be exchanged with the communication link.

2. The ballast of claim 1, wherein the first and second protection circuits comprise fuses.

3. The ballast of claim 1, wherein the second protection circuit is disposed in series with the first protection circuit after a junction of the power supply with the AC main supply.

4. The ballast of claim 1, wherein the first circuit portion comprises an input circuit including a rectifier stage and wherein the second protection circuit is disposed after the rectifier stage.

5. The ballast of claim 4, wherein the first circuit portion comprises a boost converter stage following the rectifier stage, and the second protection circuit is disposed between the rectifier stage and the boost converter stage.

6. The ballast of claim 1, wherein the first and second protection circuits are adapted to operate at the same current, but the first protection circuit comprises a slow acting protection circuit and the second protection circuit comprises a fast acting protection circuit.

7. The ballast of claim 1, wherein the sensor input comprises input from any of a photosensor, an occupancy sensor and an infrared sensor.

8. The ballast of claim 1, wherein the first protection circuit comprises a slow acting fuse and the second protection circuit comprises a fast acting fuse.

9. The ballast of claim 1, wherein the first protection circuit is adapted to operate at a higher current than the second protection circuit.

10. The ballast of claim 6, wherein the first protection circuit is adapted to operate at a higher current than the second protection circuit, and the first protection circuit is a slow acting protection circuit and the second protection circuit is a fast acting protection circuit.

11. A ballast for a gas discharge lamp comprising:

a first circuit portion operable to receive power from an AC main supply for conversion to a form suitable to drive the lamp; and a second circuit portion operable to receive power from the AC main supply for processing data;

further comprising a first protection circuit disposed in series electrical connection with the AC main supply and only the first circuit portion, such that in the event of an electrical failure leading to an overcurrent condition in the first circuit portion, the second circuit portion will continue to be operable to receive power from the AC main supply; further wherein the second circuit portion further comprises a sensor input portion adapted to receive a sensor input provided from an external sensor, and wherein the second circuit portion includes a communication port for exchanging data with a communications link, and wherein, in the event of an electrical failure in the first circuit portion leading to operation of the second protection circuit, the second circuit portion is adapted to continue receiving power from the power supply, thereby allowing the sensor input to be exchanged with the communication link.

12. A method of protecting a ballast for a gas discharge lamp in the event of an overcurrent condition comprising:

receiving power from an AC main supply for conversion by a first circuit portion of the ballast to a form suitable to supply power to the lamp;

receiving power from the AC main supply by a power supply of a second circuit portion for processing data exchanged with a communication link, the power supply coupled at the input of the AC main supply to the first circuit portion;

providing a first protection circuit coupled in series with the AC main supply for protecting the first and second circuit portions in the event of an electrical circuit failure leading to an overcurrent condition, and coupling the power supply for the second circuit portion such that it is protected by the first protection circuit; and providing a second protection circuit disposed in series with the first circuit portion and providing protection only in the event of an electrical failure leading to an overcurrent condition in the first circuit portion, the second protection circuit being adapted such that in the event of an electrical failure in the first circuit portion, the second protection circuit will discontinue the supply of current to the first circuit portion so as to prevent an overcurrent in the first protection circuit that would cause the first protection circuit to interrupt current, thereby allowing the first protection circuit to continue to supply current to the second circuit portion;

wherein the second circuit portion further comprises a sensor input portion adapted to receive a sensor input provided from an external sensor, and wherein the second circuit portion includes a communication port for exchanging data with a communications link, and wherein, in the event of an electrical failure in the first circuit portion leading to operation of the second protection circuit, the second circuit portion is adapted to continue receiving power from the power supply, thereby allowing the sensor input to be exchanged with the communication link.

13. The method of claim 12, further comprising providing the first and second protection circuits as fuses.

14. The method of claim 12, further comprising providing the second protection circuit in series with the first protection circuit after a junction of the power supply with the AC main supply.

15. The method of claim 12, wherein the first circuit portion comprises an input circuit including a rectifier stage and further comprising disposing the second protection circuit after the rectifier stage.

16. The method of claim 15, wherein the first circuit portion comprises a boost converter stage following the rectifier stage, and further comprising disposing the second protection circuit between the rectifier stage and the boost converter stage.

17. The method of claim 12, further comprising operating the first and second protection circuits at the same current, but providing the first protection circuit as a slow acting protection circuit and the second protection circuit as a fast acting protection circuit.

18. The method of claim 12, further comprising providing the sensor input from any of a photosensor, an occupancy sensor and an infrared photosensor.

19. The method of claim 12, further comprising providing the first protection circuit as a slow acting fuse and the second protection circuit as a fast acting fuse.

20. The method of claim 12, further comprising operating the first protection circuit at a higher current than the second protection circuit.

21. The method of claim 17, further comprising operating the first protection circuit at a higher current than the second protection circuit, and further providing the first protection circuit as a slow acting protection circuit and the second protection circuit as a fast acting protection circuit.

* * * * *